United States Patent [19]

Hida et al.

[11] 4,192,157

[45] Mar. 11, 1980

[54] KNITTING WIDTH INDICATION SYSTEM FOR KNITTING MACHINES

[75] Inventors: Takashi Hida, Toyota; Tsutomu Mitsui, Chiryu; Tadaaki Hashiride; Kazutaka Kuwana, both of Toyota, all of Japan

[73] Assignee: Aisin Seiki Co., Ltd., Japan

[21] Appl. No.: 880,563

[22] Filed: Feb. 23, 1978

[30] Foreign Application Priority Data

| | | | |
|---|---|---|---|
| Mar. 2, 1977 | [JP] | Japan | 52-22927 |
| Mar. 11, 1977 | [JP] | Japan | 52-27258 |
| Mar. 15, 1977 | [JP] | Japan | 52-28279 |

[51] Int. Cl.[2] ..... D04B 7/10

[52] U.S. Cl. ..... 66/76; 66/232; 66/75.2; 66/70; 66/73

[58] Field of Search ..... 66/154 A, 75.2, 70, 66/73, 76, 60; 112/121.11; 235/92 PD, 92 CT

[56] References Cited

U.S. PATENT DOCUMENTS

| | | | |
|---|---|---|---|
| 3,613,608 | 10/1971 | Hinerfeld et al. | 112/121.11 X |
| 3,641,788 | 2/1972 | Mori et al. | 66/154 A |
| 3,885,405 | 5/1975 | Bartels | 66/75.2 |
| 3,983,718 | 10/1976 | Kahan et al. | 66/75.2 |
| 3,991,592 | 11/1976 | Kahan et al. | 66/75.2 |
| 4,114,405 | 9/1976 | Bartels | 66/75.2 |

*Primary Examiner*—Ronald Feldbaum
*Attorney, Agent, or Firm*—Staas & Halsey

[57] ABSTRACT

A knitting width indication system for hand knitting machines, wherein a fabric piece pattern memory device and a pattern width indication display device cooperating with the knitting machine carriage are provided, and whereby the knitting width is read out step by step from the pattern width electronic memory device in synchronism with the traversing movement of the carriage on a needle bed to display the knitting width of each knitting step on a pattern width indication display device. The pattern width electronic memory device stores a variety of fabric outline pattern data. The fabric outline width data are read out and displayed in serial order, in synchronism with each traversing movement of the carriage. Referring to the fabric outline width datum on the display device, the operator can set the proper knitting width on the needle bed.

11 Claims, 12 Drawing Figures

KNITTING WIDTH INDICATION SYSTEM FOR KNITTING MACHINES

BACKGROUND OF THE INVENTION

The invention relates in general to flat bed home knitting machines. More particularly, the invention relates to a knitting width indication system for home knitting machines.

Home knitting machines of the flat bed type are disclosed in many patent specifications, for example, in U.S. Pat. No. 3,641,788-issued Feb. 15, 1972, U.S. Pat. No. 3,885,405-issued May 27, 1975, U.S. Pat. No. 3,983,718-issued Oct. 5, 1976 and U.S. Pat. No. 3,991,592-issued Nov. 16, 1976. Some fabric pieces, e.g., a front half piece, a back half piece and two sleeve pieces, can be knitted with the machines to make a complete article. Usually, cards or sheets having outline patterns for the fabric pieces and a knitting tracer having a pattern width measurement means are employed to determine the real knitting width on the flat needle bed. First, gauge setting for determining the traversal stitch numbers and the longitudinal fabric knitting step numbers for a transversal and longitudinal unit length of the fabric pattern on the card or sheet, respectively, is carried out. Thereafter, each width stitch number corresponding to each fabric knitting step is calculated, at each transverse movement of the carriage, using the knitting tracer to determine and select the operating needles on the needle bed at each fabric knitting step. That is, the operator reads out every width of the fabric piece outline pattern at every fabric knitting step with the knitting tracer, and then calculates the knitting needle numbers to be operated by the carriage. Needles to be operated by the carriage are manually set at a knitting operation position for every knitting step. Gauga setting, that is, the determination of the traversal stitch numbers for a transversal unit length of the fabric pattern on the card or sheet, as well as the calculation of the knitting needle numbers in every fabric knitting step, are relatively difficult for inexperienced persons. However the gauge setting and the calculation should be done correctly, because the fabric pieces are assembled in an article after fabrication, and mistakes in the gauge setting or the calculation will cause irregular formation.

SUMMARY OF THE INVENTION

One ovject of the present invention is to provide a knitting width indication system which simplifies the knitting operations of the operator.

Another object of the present invention is to provide a knitting width indication system which requires substantially no gauge setting or calculation of the knitting needle numbers.

According to the present invention, the knitting width indication system comprises an electronic memory device which contains a plurality of fabric piece outline pattern data, a pattern width indication display device and an electric control means which reads out the pattern data to display them in synchronism with each transverse movement of the carriage on the needle bed of a home knitting machine. The electric control means has a manually operated read out address setting circuit means, which determines the read out beginning address of the electronic memory device, and an automatic read out address increment circuit means which increases the read out address of the electronic memory device in synchronism with each transverse movement of the carriage. The pattern data for every fabric piece outline may preferable be that of a standard yard of middle diameter and standard fabric knitting step (longidudinal stitch pitch), because yarns and fabrics made from them have expansibility enough to fit different physiques.

DESCRIPTION OF THE EMBODIMENTS

Figure 1:
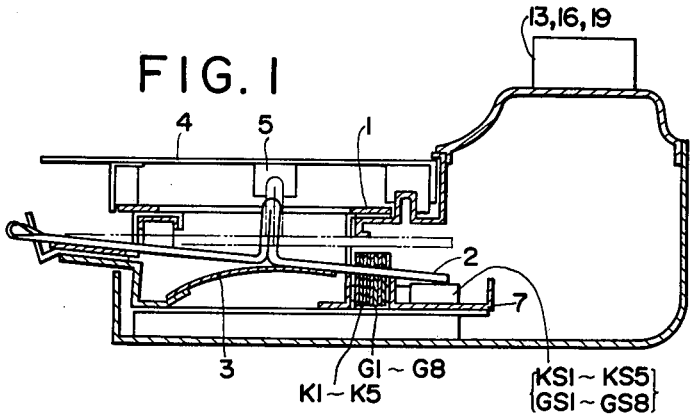
FIG. 1 shows cross-sectional view of a home knitting machine to which the system of the present invention can be applied.
Figure 2:
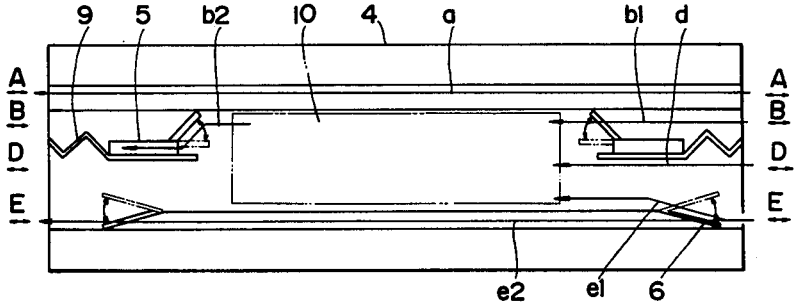
FIG. 2 shows the needle guide passages of the carriage 4 shown in FIG. 1.
Figure 3A:
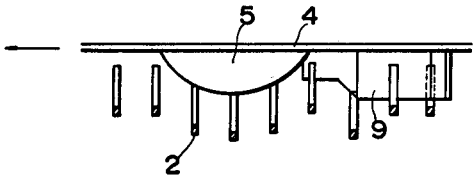
FIG. 3*a* shows a side view of a depression cam 5 of the carriage 4.
Figure 3B:
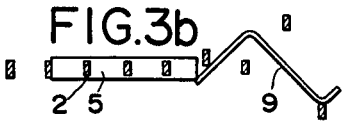
FIG. 3*b* shows the bottom view of the depression cam 5.

First, the mechanical construction of a home knitting machine to which the system of the present invention can be applied will be described, referring to FIG. 1 through FIG. 6. In FIG. 1, a plurality of needles 2 are arranged under a needle bed 1. The needles 2 are parallely arranged along the longitudinal axis (which is vertical to the drawing) of the needle bed 1 and are movable toward a carriage 4 and along their longitudinal axes. The needles 2 are normally baised upward by leaf springs 3. The raised positions (high bat state) of the needles 2 are shown by a phantom line in FIG. 1. Carriage 4 is provided with depression cams 5, successively depress the bat portions of the needles 2 at the fabric knitting position during the transverse movement (along the longitudinal axis of the needle bed 1) of the carriage 4. Needles out of the fabric knitting position are not depressed by the cam 5. Namely, needles out of the fabric outline are previously taken out of the traverse movement passage of the cam 5, in which case the bat portions of the needles are on a line A in relation to the carriage 4 as shown in FIG. 2. In FIG. 2, needles whose bat portions are on a line B pass along a line b1 into fabric knitting cam portion 10 during traverse movement of the carriage 4 and then come to a line b2 on which the needles are depressed by the cam 5. Needles whose bat portions are on a line D pass along a line d into fabric knitting cam portion 10 and then come to the line b2 on which the needles are depressed by the cam 5. Needles whose bat portions are on a line E pass along a line e1 into the fabric knitting cam portion 10 when a knit-tuck gate cam 6 is at the solid line position, and then come to the line b2 on which the needles are depressed by the cam 5. When the knit-tuck gate cam 6 is at the phantom line position, the needles pass along a line e2 and are not depressed by the cam 5. Thus the needles whose bat portions come into the fabric knitting cam portion 10 are depressed by the cam 5. The depression of the needles by the cam 5 is shown in FIG. 3*a*. Depressed needles are separated into two groups by separator 9 as shown in FIG. 3*b*. This separation of the needles depends on holding a group of needles at the depressed position until the bottom of the separator 9 passes through them. Fabric stitches are constructed with yarns when the bat portions of the needles pass the fabric knitting cam portion 10 of the carriage 4. These fabric stitches are formed with yarns by the operation of the needles 2 and the carriage 4, as is well known in the field of flab bed home knitting machines and explained in the foregoing U.S. Pat. No. 3,991,592.

Figure 4:
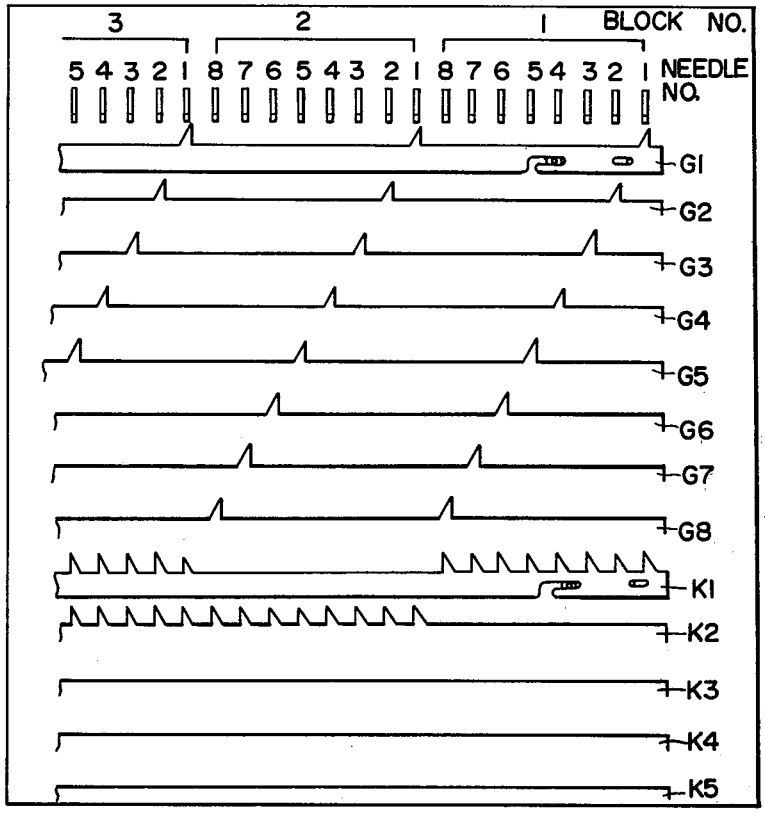
FIG. 4 is a pictorial disassembled side diagram of first and second groups of carriage position detector plates.
Figure 5:
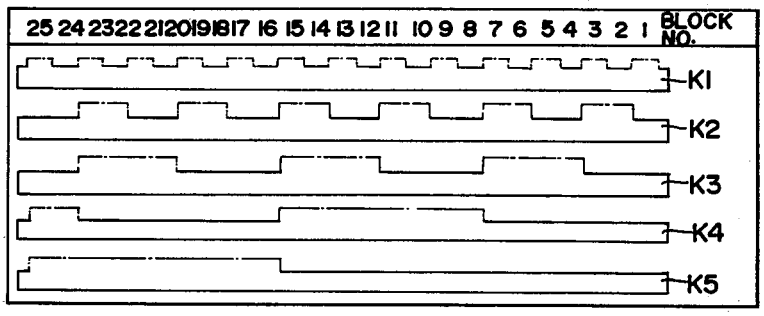
FIG. 5 is a pictorial disassembled plane diagram of the second group of carriage position detector plates.
Figure 6:
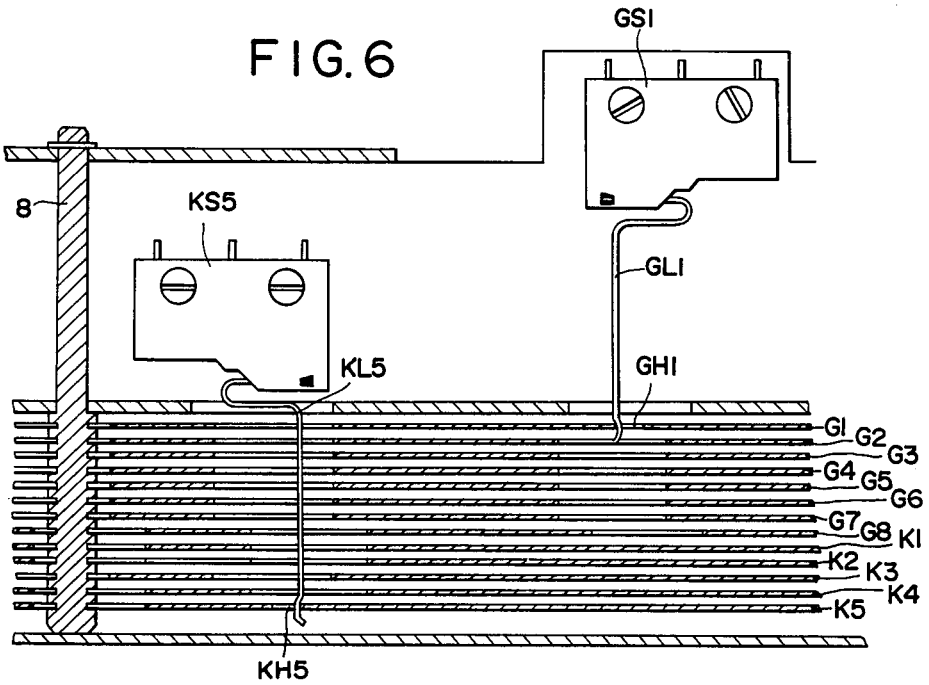
FIG. 6 is a plane view of the carriage position detector plates of the first and second groups.

A plurality of carriage position detector plates G1-G8 and K1-K5 are provided under the needle bed 1 as shown in FIG. 1 and FIG. 6. The carriage position detector plates G1-G8 and K1-K5 cross the needles 2 and are movable with respect to them. A holder plate 7 guides the movement of the plates. Each plate G1-G8 and K1-K5 has taper portions as shown in FIG. 4 and FIG. 5. Depression of a needle by the cam 5 of the carriage 4 causes a plate of the first group G1-G8 and at least one plate of the second group K1-K5 to move against a spring means (not shown). For example, when a needle No. 1 of block No. 1 (FIG. 4) is depressed by the cam 5, a plate G1 and a plate K1 move toward the right and left, respectively, because the needle engages the taper portions of the plates G1 and K1. Thus the numbers of the needles depressed by the cam 5 (i.e., carriage positions) are detected by detecting movements of the plates G1-G8 and K1-K5. To detect the movements of the plates, sensor switches GS1-GS8 and KS1-KS5 are provided on the holder plate 7 along the longitudinal axis of the plates G1-G8 and K1-K5. Each of the switches GS1-GS8 and KS1-KS5 is operated by the plates G1-G8 and K1-K5 respectively. Every switch GS1-GS8 and KS1-KS5 has an actuator lever GL1-GL8 and KL1-KL5 respectively, each of which engages a small opening GH1-GH8, KH1-KH5 in plates G1-G8, K1-K5 through openings in the other plates G1-G8, K1-K5 so as to couple one of the plates G1-G8 and K1-K5. As shown in FIG. 4 and FIG. 5, every plate G1-G8 of the first group has a taper portion in every needle block, whereas every plate K1-K5 of the second group has a plurality of taper portions. Thus the activation of every switch GS1-GS8 of the first switch group indicates the number of a depressed needle in a block, and activation of one or more switches K1-K5 of the second switch group indicates a block number in which a depressed needle is included. The indication of needle numbers in a block by the switches GS1-GS8 is a single relation between the needles and the switches, whereas the indication of block numbers by the switches K1-K5 is a binary-coded decimal notation. Depressed needle numbers, i.e. carriage position, are thus indicated with the needle numbers in a block and the block numbers in the entire needle array. Needle numbers thus obtained are transmitted to an electronic center control device (not shown) as carriage position indication signals, which are employed for fabric knitting control and color pattern knitting control in the center control device, as is well known in the art.

Figure 7:
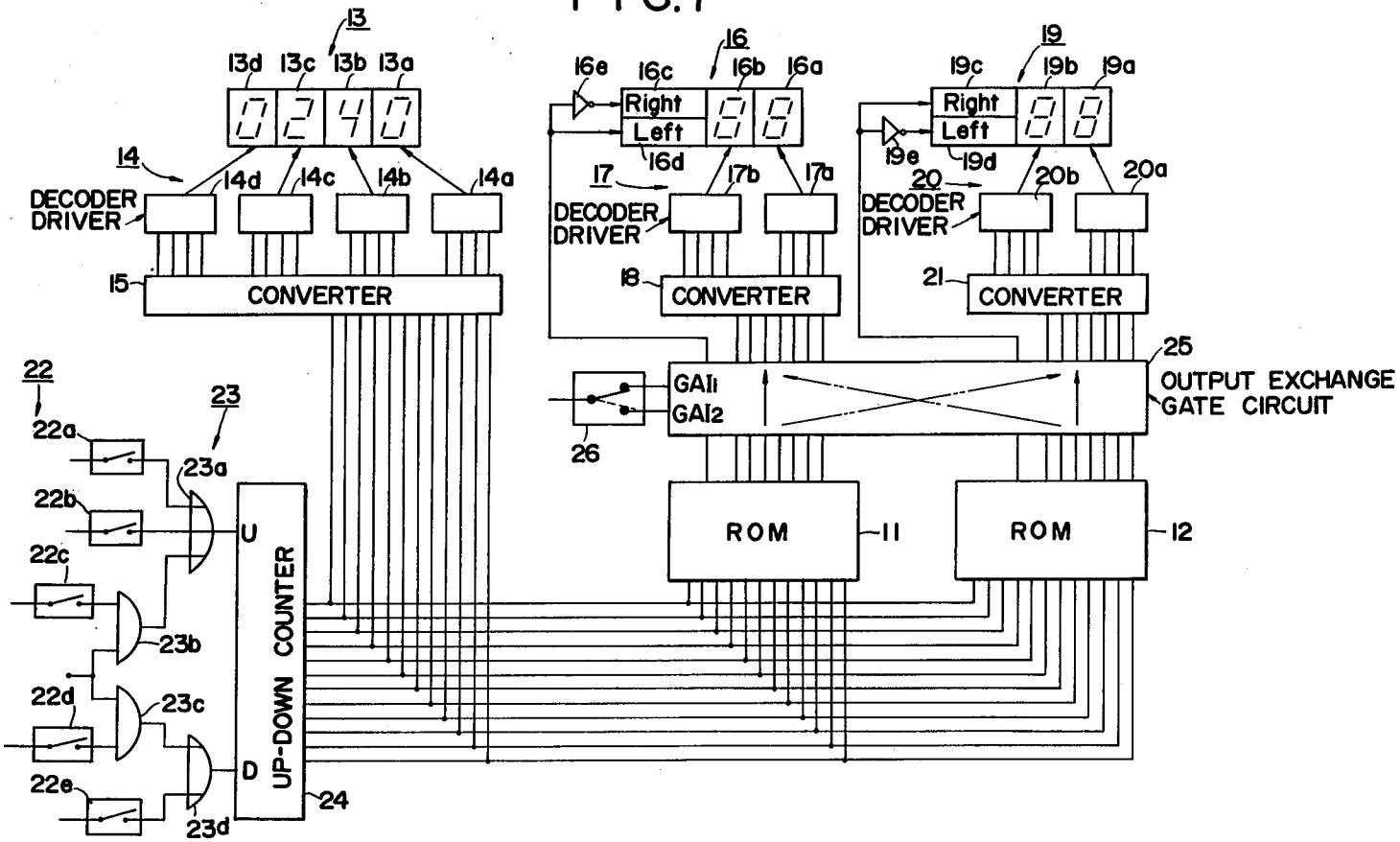
FIG. 7 is a block diagram of an embodiment of the present invention.

Refereing to FIG. 7, which shows an embodiment of the present invention, the electronic memory device of the invention includes semiconductor read only memory chip devices 11 and 12. The pattern indication display device includes read out address display unit 13, its decoder driver 14, converter 15, left half width display unit 16, its decoder driver 17, converter 18, right half width display unit 19, its decoder driver 20 and converter 21. The electric control means includes read out address setting switches 22, gate elements 23, up-down counter 24, output exchange gate circuit 25 and a change over switch 26.

Figure 8:
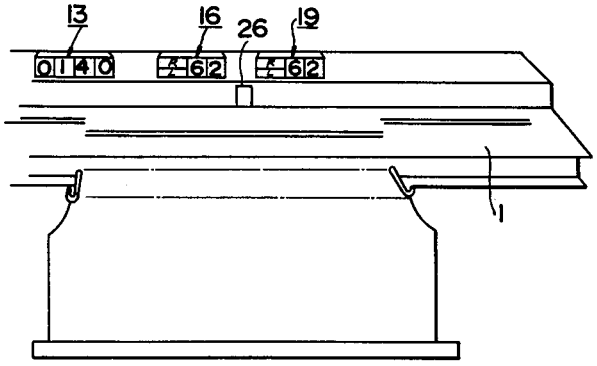
FIG. 8 is a pictorial front view of a home knitting machine equipped with the system of the embodiment shown in FIG. 7.

Switches **22*a* and 22*b* of the read out address setting switches 22 are connected with an OR-gate element 23*a* of the gate elements 23. A series of clock pulses are supplied to AND-gate elements 23*b* and 23*c* from a pulse generator means (not shown). Switches 22*c* and 22*d* are connected with input terminals of the AND-gate elements 23*b* and 23*c*. The output of the AND-gate element 23*c* is connected with an input terminal of an OR-gate element 23*d*. A switch 22*e* is connected with another input terminal of the OR-gate element 23*d*. The output of the OR-gate element 23*a* is connected with the UP input terminal of the counter 24, whereas the output of the OR-gate element 23*d* is connected with the DOWN input terminal of counter 24. The binary coded output of counter 24 is supplied to the memory chip devices 11 and 12, as well as to converter 15. The binary code bits from the counter 24 are converted to binary coded decimal by the converter 15, and this is supplied to the decoder drivers 14*a*–14*d* respectively. Decoder drivers 14*a*–14*d* respectively energizes segments in display units 13*a*–13*d*. The output bits of the counter 24 are supplied to the semiconductor memory chip devices 11 and 12 as the read out address indication signal. With switch 26 connected to terminal GAI 1, one data bit read out of the memory chip device 11 is supplied through the gate circuit 25 to a driver circuit for a lamp 16*d*, and the inverted signal is supplied to a driver circuit for a lamp 16*c* through an inverter 16*e*. The other seven data bits from the memory chip device 11 are supplied through the gate circuite 25 to converter 18 and decoder drivers 17*a*, 17*b* to energize segments of display units 16*a* and 16*b*. Similarly a bit of read out data from the memory chip device 12 is supplied through the gate circuite 25 to a driver circuit for a lamp 19*c*, and the inverted signal is supplied to a driver for a lamp 19*d* through an inverter 19*e*. The other seven data bits from the memory chip device 12 are supplied through the gate circuit 25 to converter 21 and decoder drivers 20*a*, 20*b* to energize segments of display units 19*a* and 19*b*. With switch 26 turned to terminal GAI 2, data read out of the semiconductor chip devices 11 and 12 are supplied to display unit 19, converter 21, display unit 16, and converter 18 respectively. The lamps 16*c* and 19*c* display letters "Right" when energized, and the lamps 16*d* and 19*d* display letter "Left" when energized. The switch 22*a* is fixed at the center of the home knitting machine as shown in FIG. 8, and is operated by an operator member on the carriage. Thus the switch 22*a* is operated once every traverse movement of the carriage to knit a step or course of the fabric. The switches 22*b*, 22*c*, 22*d* and 22*e* of the read out address setting switches 22, as well as display change over switch 26, are designed and fixed to be operated manually. Closure of the switch 22*b* which is attached to OR-gate element 23*a*, causes counter 24 to be incremented by one. A series of relatively short cycle clock pulses is supplied to the UP or DOWN input terminals of the counter through AND-gate elements 23b or 23c and OR-gate elements 23a or 23d during the closure of the switches 22c or 22d respectively. Thus the counter 24 counts up or down rapidly during the closure of the switches 22c or 22d respectively. Closure of the switch 22e which is attached to OR-gate element 23d, causes counter 24 to be decremented by one. The converters 15, 18 and 21 convert the output binary code of the counter 24 into a binary coded decimal code. Each of the decoder drivers 14, 17 and 20 is constructed with a decoder which converts binary coded decimal code to a seven segments code, and a seven segments driver circuit. The segments display units 13a–13d, 16a and 16b, as well as 19a and 19b, are constructed with light display elements such as light emitting diodes. Those display units 13, 16 and 19 are fixed on the home knitting machine as shown in FIG. 8**.

Figure 9:
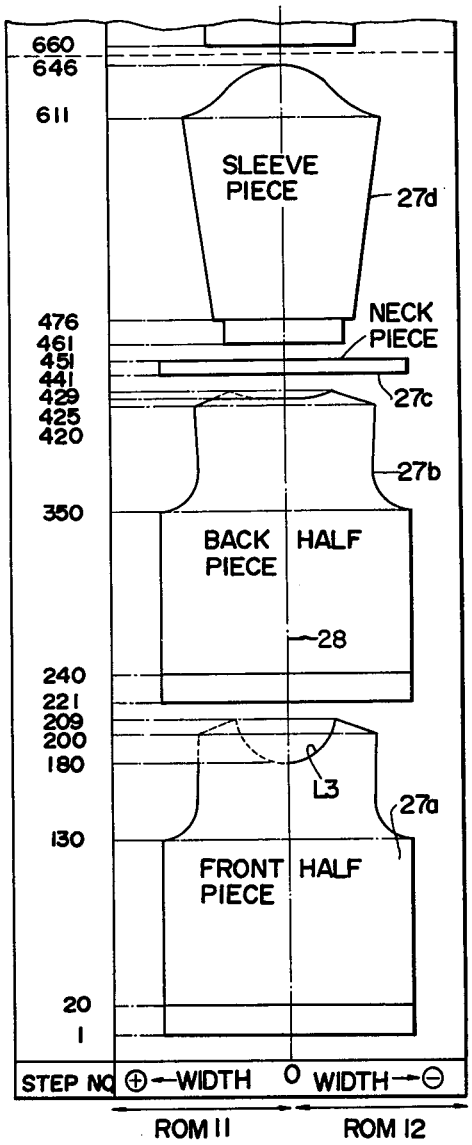
FIG. 9 shows fabric pieces outlines whose width data are memorized in the electronic memory device.

The semiconductor memory chip devices 11 and 12 contain width data concerning fabric piece outline patterns such as those shown in FIG. 9. The outlines of the patterns 27a, 27b, 27c, . . . can be imagined as being separated into two parts, i.e., a right half part and a left half part, by the longitudinal center line 28. The right width data, which indicate stitch numbers corresponding to the right half part width of the outline from the center line 28, are stored in the semiconductor chip device 12, and left width data indicating stitch numbers corresponding to the left half part width of the outline from the center line 28 are stored in the semiconductor chip device 11. The read out addresses (STEP No. in FIG. 9) of the memory devices 11 and 12 correspond to the step number or course number of the fabric pieces. The memory devices 11 and 12 have eight memory bits in every read out address, one bit of which (the "orientation bit") indicates whether the right side of the fabric outline is at the right side of the center line 28 or not (with respect to memory device 12), or whether the left side of the fabric outline is at the left side of the center line 28 or not (with respect to memory device 11). The remaining seven bits of the memory devices 11 and 12 indicate the half width (stitch numbers) from the center line 28 toward the left and right side of the outlines 27a, 27b, . . . respectively. State "1" of the orientation bit of the memory device 12 indicates that the right side of the fabric outline is at the right side of the center line 28, and state "0" indicates that the right side of the fabric outline is at left side of the center line 28. State "1" of the orientation bit of the memory device 11 indicates that left side of the fabric outline is at left side of the center line 28, and state "0" indicates that left side of the fabric outline is at right side of the center line 28. The memorized width data are read out selectively and successively in correspondence with the count of the counter 24. The outlines of patterns 27a, 27b, 27c, . . . represent width data which are memorized in the semiconductor memory chip devices 11 and 12, and the address numbers (ROM STEP NO.) are preferably printed on cards, sheets or a text book for the operator's reference.

The system shown in FIG. 7 and described hereinbefore may be included in the housing of the home knitting machine. The operation of the system shown in FIG. 7 is described hereinafter.

To knit the front half part 27a, an operator operates read out address setting switches 22 so as to display "20" on the display unit 13. By closing the switches 22c and 22d the numerals on the display unit 13 increase or decrease rapidly. The numerals on the display unit 13 can be increased or decreased one step at a time by operating switches 22b or 22e. Thus the operator can set the numerals "20" on the display unit 13 with the switches 22b, 22c, 22d and 22e. The switch 26 should be connected with the terminal GAI 1. By setting the display numeral at "20", the memorized data addressed by this step number are supplied to display units 16 and 17 from the memory devices 11 and 12 through converters 18, 21 and decoder drivers 17, 20. Thus the left half stitch number (the left half needle number to be selected by the operator to determine the knitting stitch number of the left half side) is displayed on the units 16a and 16b, and the lamp 16d is energized to show the letters "Left". The right half stitch number (the right half needle number to be selected by the operator to determine the knitting stitch number of the right half side) is displayed on the units 19a and 19b, and the lamp 19c is energized to show the letters "Right". The operator, referring to the indications on the display units 16 and 19, connects a yarn between the left and right side needles which are indicated on the display units 16 and 19, then traverses the carriage on the needle bed to knit the first step or course of the front half piece of fabric. Traversing the movement of the carriage operates the switch 22a to increment counter 24 by one, so that the display unit 13a shows numeral "21" and the memory devices 11 and 12 supply out knitting width data for the second step or course. This operation is continued by repeatedly traversing the carriage on the needle bed. The operator, referring to the numerals on the display units 16 and 19, increases or decreases the stitch numbers in every course of the fabric. The two separated portions after address No. 180 (knitting step or course No. 180) cannot be knit at the same time. Therefore the operator first knits the right half of the fabric from the knitting step 180 to 209, in which case the lamp 16c is energized to show the letters "Right" and units 16a and 16b shows the stitch number of the left side LS (FIG. 9) from the center line 28. The operator sets the stitch numbers which corresponds to the difference between the numerals shown on the units 16 and 19. After the fabrication of the step No. 209, the operator sets the read out address on the display unit 13 into "180" by actuating the switches 22b, 22c, 22 d or 22e and changes the switch 26 to connect with the terminal GAI 2, by which the output data of the memory device 12 are supplied to converter 18 and lamps 16c, 16d, whereas the output data of the memory device 11 are supplied to converter 21 and lamps 19c, 19d. Thus lamps 16d and 19d are energized to show "Left" and the right side width data of the pattern 27a are displayed on the units 16. The left side width data (LS) are displayed on the units 19. Namely the display units 16 and 19 shows data to knit the left half portion shown by dotted line in FIG. 9.

In the system shown in FIG. 7, the operator must calculate the increased or decreased width difference between the data shown on the display units 16, 19 for one step and the preceding step. The fabric stitch number adjustment for each step represents either an increase or a decrease of the stitches of preceding step or course. The system shown in FIG. 10 has additional display units 27 and 30 to indicate incremental or decremental stitch number. The incremental or decremental stitch number, i.e., the stitch difference between one step and the preceding step, is calculated by subtractors 33 and 34, each of which calculates the stitch difference number of the left half width and the right half width respectively. Stitch numbers B of the succeeding step are supplied to the subtractors 33 and 34 from the semiconductor memory chip devices 11 and 12 respectively. Stitch numbers A of the preceding step are supplied to the subtractors 33 and 34 from latches 35 and 36 respectively. To control data replacement in the latches 35 and 36, mono-stable multivibrators 37 and 38 are provided. The multivibrators 37 generates a pulse at the time when the switch 22*a* closes. The multivibrator 38 generates a pulse at a time when the switch 22*a* opens. Data replacement in the latches 35 and 36 is controlled by an output pulse T of the multivibrator 37 when the switch 22*a* is closed by a permanent magnet on the carriage 4, and then the read out address for the memory devices 11 and 12 is increased by one by an output pulse of the multivibrator 38 when the magnet 41 passes away from switch 22*a*. Thus the subtracters 33 and 34 normally receive the stitch number of a succeeding step from the memory devices 11 and 12 as well as the stitch number of the preceding step, controlled by latches 35 and 36, except during the closure interval of the switch 22*a*. Change over switches 39 and 40 are operated in synchronism with the change over switch 26.

In this embodiment of the present invention, one of the eight bits from each ROM is used to indicate a mark of + or −, "1" indicating a mark + and "0" indicating a mark −. The width as measured from the center line 28 (FIG. 9) toward the left is assumed to be + (plus), and the width measured from the center line 28 toward the right is assumed to be − (minus). The remaining seven bits indicate the half width number of stitch number. Some contents of the memory devices 11 and 12 are shown in Table 1 for the sake of illustration. The numerals in Table 1 are in binary code notation in the memory devices 11 and 12.

Table 1

| STEP No. (Address No.) | ROM 11 DATA | ROM 12 DATA |
|---|---|---|
| • | • | • |
| • | • | • |
| • | • | • |
| • | • | • |
| • | • | • |
| • | • | • |
| 20 | +80 | −80 |
| 21 | +81 | −81 |
| 22 | +79 | −79 |
| • | • | • |
| • | • | • |
| • | • | • |
| • | • | • |
| • | • | • |
| • | • | • |
| 180 | +58 | −58 |
| 181 | −7 | −58 |
| 182 | −12 | −58 |

To knit the front half part 27*a*, an operator operates read out address setting switches 22 so as to display "20" on the display unit 13. By setting the display numeral at "20", the memorized data of address No. 20 are supplied to display units 16 and 17 from the memory devices 11 and 12 through converters 18, 21 and decoder drivers 17, 20. Thus the left half stitch number "80" is displayed on the units 16*a* and 16*b*, and the lamp 16*d* is energized to show letters "Left". The right half stitch number "80" is displayed on the units 19*a* and 19*b*, and the lamp 19*c* is energized to show letters "Right". The operator, referring the indications on the display units 16 and 19, connects a yarn between left and right side needles which are indicated on the units 16 and 19, and then traverses the carriage 4 on the needle bed to knit the first step (No. 20) of the fabric piece. The traversing movement of the carriage 4 operates the switch 22*a*, so that latches 35 and 36 introduce the data +80 and −80 of the first step number 20 and memory devices 11 and 12 supply the data +81 and −81 of the second step number 21 respectively. Then the display unit 13 indicates "21", the display unit 16 indicates "Left 81" and the display unit 19 indicates "Right 81". In addition, the difference between "80" of latch 35 and "+81" of memory device 11, and the difference between "80" of latch 36 and "−81" of memory device 12, are calculated in the subtracters 33 and 34 respectively. The output of the subtracter 33, respresenting "−1", is supplied to decoder driver 28 and the lamp driver circuits of lamps 27*c* and 27*d*. The "−" mark is indicated by a "0" bit, which energizes the lamp 27*c* to show "+" and inform the operator to increase the knitting stitch number toward left. The number "1" is indicated on the units 27*a* and 27*b*. The output of the subtracter 34, representing "+1," is supplied to decoder driver 31 and lamp driver circuits of lamps 30*c* and 30*d*. The "+" is indicated by a "1", which energizes the lamp 30d to show "−" and inform the operator to increase the knitting stitch number toward right. The number "1" is indicated on the units 30*a* and 30*b*. Referring to the indications on the display units 27 and 30, the operator increases the knitting stitch number towards the left and right, both by one. Then the operator traverses the carriage 4 on the needle bed 1, whereupon the display unit 13 indicates "22", the display unit 16 indicates "Left 79", the display unit 19 indicates "Right 79", the display unit 27 indicates "−2" and the display unit 30 indicates "+2". The operator, referring to the indications "−2" and "+2" of the display units 27 and 30, decreases the knitting stitch numbers towards the right and left (i.e., toward the center line 28) both by two. Then the operator traverses the carriage 4 on the needle bed 1, and so on. The separated two portions after address No. 180 (FIG. 9 and Table 1) cannot be knit at the same time. Therefore the operator first knits the right half of the fabric from the knitting steps number 180 to 209, in which case the lamp 16*c* is energized to show "Right" and the display units 16*a* and 16*b* indicate the width measured from the center line 28 to the left side LS of the fabric piece pattern 27*a* (FIG. 9 and Table 1). The display unit 27 shows "−65" after the knitting of the step 180, which advise the operator to shift the left side of the knitting needle toward the right by 65. Thereafter the operator continues in the same manner, as compared with the knitting operation between step 20 and step 180. After the knitting of the right half part from step No. 180 to No. 209 is finished, the operator sets the read out address on the display unit 13 again into "180" by actuating the switches 22*b*, 22*c*, 22*d* or 22*e* and changes the switch 26 to connect with the terminal GAI 2, in which case the switches 39 and 40 turn to connect with the inverters 42 and 43 respectively. Then the output data of the memory device 11 are supplied to converter 22, subtracter 34 and latch 36 through the gate circuit 25, whereas the output data of the memory device 12 are supplied to converter 18, subtracter 33 and latch 35. In this case the inverters 42 and 43 invert the mark signal bit so as to change the data of the right half portion into that of left half portion and the data of the left half portion into that of right half portion respectively. The operator continues in the same manner, as compared with the knitting operation between step 20 and step 180 and between step 180 and 209 for right half knitting. Thus the left half part (shown by a dotted line In FIG. 9) between step 180 and 209 will be knitted by the operator.

In this embodiment of the invention, the operator requires the left and right half width shown by the display units 16 and 19 during the first knitting step or course of a fabric piece. However, during succeeding steps the operator does not require the left and right half width shown by the display units 16 and 19, because increases or decreases are indicated on the display units 27 and 30. Thus the display units 16 and 27 may be combined in a single unit, and the display units 19 and 30 may be combined in a single unit, as shown in FIG. 11.

Figure 10:
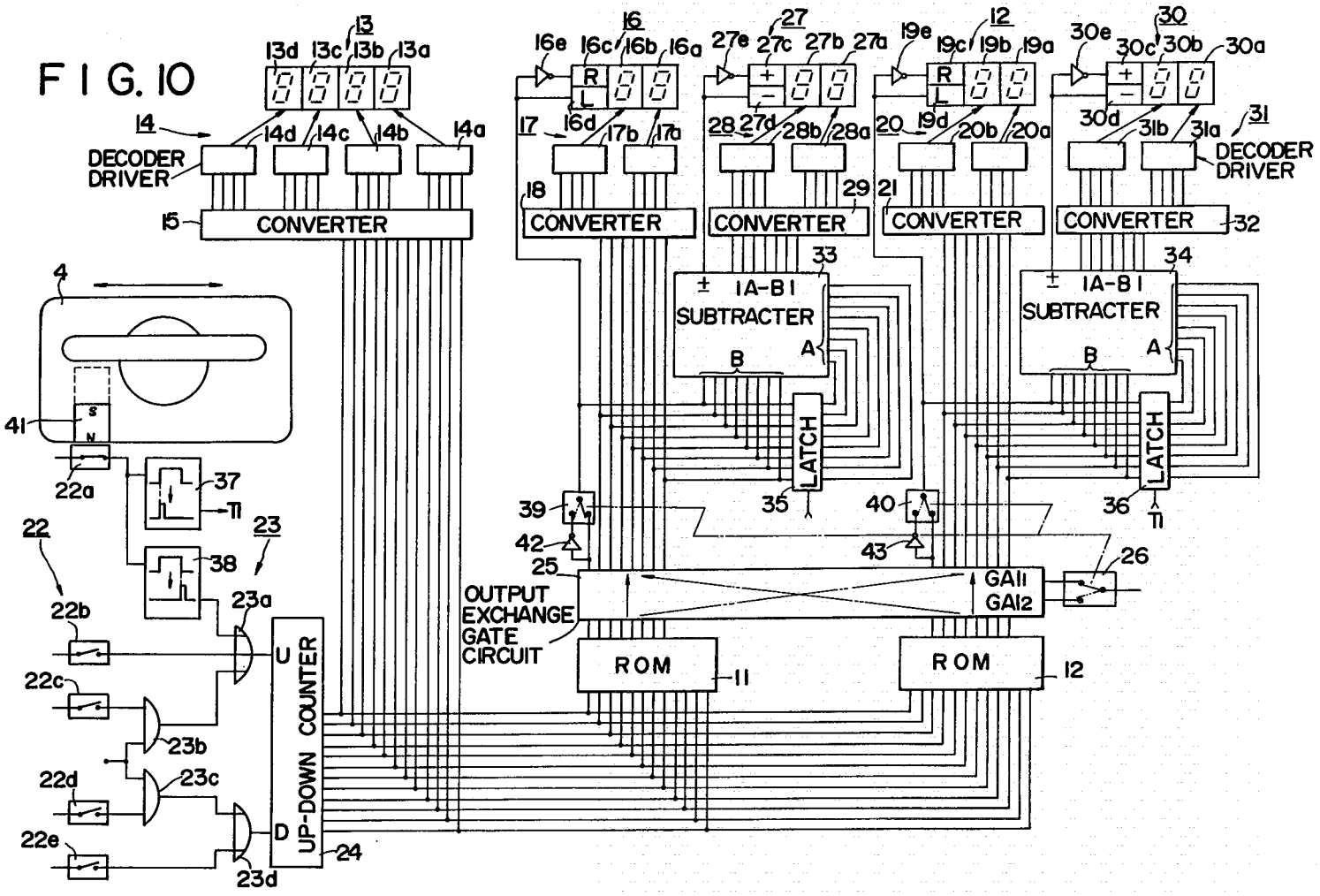
FIG. 10 is a block diagram of a preferred embodiment of the present invention.
Figure 11:
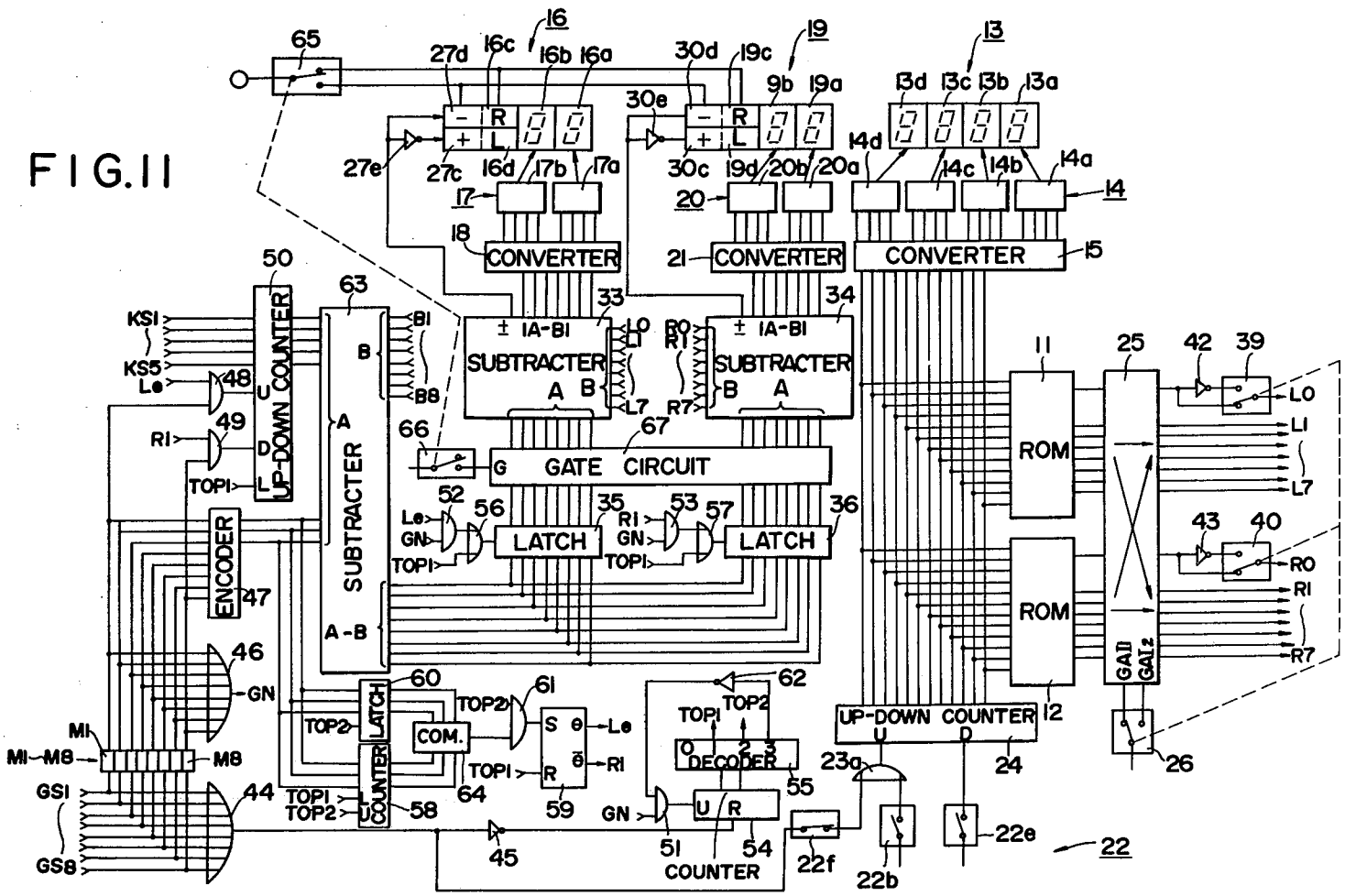
FIG. 11 is a block diagram of a further preferred embodiment of the present invention.

In the system shown in FIG. 11, closure signals from sensor switches GSI-GS8 (FIG. 1 and FIG. 6) are supplied to an OR-gate element 44 and mono-stable multivibrators M1-M8. The multivibrators M1-M8 respectively generate a short width pulse when the sensor switches close. Namely, when the sensor switches GS1-GS8 are serially closed by the cam 5 of the carriage 4, the multivibrators serially generate short width pulses. The output of the OR-gate element 44 is supplied to an inverter 45 and the OR-gate element 23*a* through a manually operated switch 22*c*. The outputs of the multivibrators M1-M8 are supplied to an OR-gate element 46 and an encoder 47. Rhe outputs of the first multivibrator M1 and the eighth multivibrator M8 are supplied to AND-gate elements 48 and 49 respectively. Closure signals from the sensor switches K1-K5 are supplied to input terminals of an UP-DOWN counter 50. The output signal GN of the OR-gate element 46 is supplied to AND-gate elements 51, 52 and 53. The AND-gate element 51 supplies an UP indication signal to an UP counter 54. The output count code of the counter 54 is supplied to a decoder 55. A first order bit TOP1 from the decoder 55 is supplied to the LOAD input terminal of the counter 50, OR-gate elements 56 and 57, the LOAD input terminal of an UP counter 58 and the RESET input terminal of an R-S flip flop 59. A second order bit TOP2 from the decoder 55 is supplied to the LOAD input terminal of a latch 60, the UP input terminal of the counter 58 and an AND-gate element 61. A third order bit TOP3 from the decoder 55 is inverted by an inverter 62 and supplied to the AND-gate element 51. The binary output code of the encoder 47, which indicates the needle number in a needle block, is supplied to the counter 58, latch 60 and a subtracter 63. The output of the counter 58 is compared with that of the latch 60 in a comparator 64, the output terminal of which is connnected with an input terminal of the AND-gate element 61 which supplies the SET signal to the flip flop 59. The comparator 64 supplies a "1" signal when the input signals are equal. The output Le of the flip flop is supplied to AND-gate elements 48 and 52, whereas output Ri of the flip flop 59 is supplied to AND-gate elements 49 and 53. The AND-gate elements 48 and 49 respectively supply UP and DOWN indication signals to the UP-DOWN counter 50. The output count code of the counter 50 is supplied to the subtracter 63, such as a full adder circuit. Binary code B1-B8, which indicates the standard center needle number, is supplied to the subtracter 63 from a previously set code generator (not shown). The code B1-B8 will be (1, 1, 0, 1, 0, 1, 1, 0) when the standard center needle is needle number 4 in 13th block (FIG. 5). Subtraction data A-B, i.e., the output of the subtracter 63, are supplied to the latches 35 and 36. The OR-gate elements 56 and 57 supply LOAD signals to the latches 35 and 36 respectively. A power switch 65 and a gate control switch 66 are mechanically connected to operate in synchronism. When the switches 65 and 66 are at the positions shown in FIG. 11, the lamp driver circuits for the lamps 16*c*, 16*d*, 19*c* and 19*d* are connected to the power supply line and the gate circuit 67 is in the OFF state. Therefore the A inputs of subtracters 33 and 34 are zero. The display units 16 and 19 in FIG. 11 operate in the same manner as those shown in FIG. 10. However, when the switches 65 and 66 are changed from the positions illustrated in FIG. 11, the lamp driver circuits for the lamps 27*c*, 27*d*, 30*c* and 30*d* are connected to the power supply line and the gate circuit 67 is in the ON state. Therefore the A inputs of subtracters 33 and 34 are the output data of the latches 35 and 36. The display units 16 and 19 in FIG. 11 operates, generally speaking, in the same manner as display units 27 and 30 in FIG. 10.

The input code A of the subtracter 63 indicates the carriage position, i.e., the needle number depressed by the cam 5. The input code B1-B8 indicates, as described hereinbefore, the standard center needle number. Thus the output code A-B of the subtracter 63 indicates the stitch number between the standard center needle and a needle currently being depressed by the cam 5.

Moving carriage 4 to the left, the count code of the counter 50 is increased by one due to an output pulse from the multivibrator M1 (which indicates that number 1 needle is being depressed by the cam 5) through the AND-gate 48. As is seen in FIG. 4, the block number should increase by one when the cam 5 actuates the sensor switch GSI through the position detector plate G1 and a number 1 needle. Moving carriage 4 to the right the count code of the counter 50 is decreased by one by an output pulse from the multivibrator M8 (which indicates that a number 8 needle is being depressed by the cam 5) through the AND-gate 49. As is seen in FIG. 4, the block number should be decreased by one when the cam 5 actuates the sensor switch GS8 through the position detector plate G8 and a needle number 8. The counter 58, flip flop 59, latch 60, AND-gate 61 and comparator 64 form a carriage traversing direction detector circuit. An output state of the flip flop 59 equal to "1" indicates that the direction of the carriage 4 is toward left, whereas Ri in the "1" state indicates that the direction of the carriage 4 is toward right. The counter 54, decoder 55, AND-gate elements 51, 52 and 53, and OR-gate elements 56 and 57 form a latch control circuit. The output A-B code of the subtracter 63 is introduced into the latches 35 and 36 When the decoder 55 generates signal TOP1 ("1" state). Then the latch 35 introduces new A-B data from the subtractor 63 when GN rises at the output terminal of OR-gate 46 during the Le ("1" state). The latch 36 introduces new A-B data from the subtracter 63 when GN arrises during the Ri ("1" state). Namely, the number of the first needle (including the block number) depressed by the cam 5 is memorized in the latches 35 and 36. Then the number of the subsequently depressed needle (including block number), if the carriage 4 is traveling toward the left (Le=1, Ri=0), is serially memorized instead of the number of the previously depressed needle in the latch 35. If the carriage 4 is traveling toward the right (Le=0, Ri=1,), the number of the subsequently depressed needle is serially memorized instead of the number of the previously depressed needle in the latch 36. The output of the OR-gate 44 is high ("1") when the cam 5 is within the knitting width, and low ("0") when the cam 5 is out of the knitting width. Therefore one pulse is supplied to the UP terminal of the counter 309 through a manually operated switch 22*f* and the OR-gate element 23*a* during one step or course of knitting. Thus the read out address of the semiconductor memory chip devices 11 and 12 increases synchronism with the step or course of the knitting operation providing that the switch 22*f* is closed. The memory devices 11 and 12 have width data such as shown in Table 1 and described hereinbefore.

To knit the front half part 27*a*, an operator activates the switches 22*b* or 22*e* so as to display "20" on the display unit 13, and sets the switches 22*f*, 26, 39, 40, 52 and 65 at the positions shown in FIG. 11. Then the memorized data of address number 20 (Table 1 and FIG. 9) are supplied to display units 16 and 19 from the memory devices 11 and 12 through converters 18, 21 and decoder driver 17, 20. Thus "Left 80" is shown by the display unit 16 and "Right 80" is shown by the display unit 19. The operator, referring the indications on the display units 16 and 19, connects a yarn between the left side needle and the right side needle which are indicated on the units 16 and 19. Then, traversing the carriage 4 on the needle bed, the operator knits the first step (No. 20) of the fabric piece. Assuming that the carriage 4 is traversed toward the right in the first step (No. 20), the counter 54 is held in the RESET condition and the decoder 55 produces a "1" output at the output 0 terminal before the cam 5 of the carriage comes to the left side outer needle of the previously set knitting needles. When the cam 5 depresses the left side outer needle, the output of OR-gate 44 rises and the UP-DOWN counter 24 counts up by one, by which the display unit 13 indicates "21". At the same time the RESET signal to the counter 54 disappears, and the counter 54 counts up by one upon an output pulse GN from OR-gate 46. Thus the decoder 55 produces a "1" signal at its terminal 1 (TOP 1). At this time the flip flop 59 produces an Ri output of "1" and the code A provided to the subtracter 63 indicates the needle number of the left side outer needle. Therefore the output A-B code of the subtracter 63 indicates "+80," which corresponds to the left width. The output A-B code is stored in the latches 35 and 36 when the output signal TOP1 appears. When the cam 5 depresses the next right hand needle to the left side outer needle, the OR-gate 46 supplies a pulse GN and the decoder 55 shifts the "1" signal to terminal 2 (TOP2). The A-B code of the subtracter 63 indicates "+79," which is newly memorized in the latch 36. The latch 35 has the memory of "80". Continued movement of the cam 5 toward the right thus changes the A-B code of the subtracter 63 and the memory of the latch 36, such as "+78", "+77", "+76" . . . When the cam 5 depresses the standard center needle, the A-B code of the subtracter 63 and the memory of the latch 36 is "0". Continued traversing movement of the cam 5 further changes the A-B code of the subtracter 63 and the memory of the latch 36, such as "−1", "−2", "−3", . . . When the final right side outer needle of the previously knitting needles is depressed by the cam 5, the latch 36 memorizes "−80," by which the knitting of the first step (No. 20) is accomplished. At this time the count code of the counter 24 indicates "21" and the output codes of the memory devices 11 and 12 are "+81" and "−81," which are shown on the display units 16 and 19 respectively. Closing the switch 65 to lamps 27*c*, 27*d* and 30*c*, 30*d*, and the switch 66 to gate control terminal G of the gate circuit 67, the subtracters 33 and 34 produce codes which indicate the differences "−1", "+1" between the memories "+80", "−80" of the latches 33, 34 and "+81", "81" of the memory devices 11 and 12 respectively. Thus the display unit 16 and 19 shows "+1" and "−1" respectively. The operator, referring to the indications "+1" and "−1", increases the left and right side outer ends of the knitting width. Then the operator traverses the carriage toward the left (knitting operation of the second step No. 21). In this knitting step, when the cam 5 depresses the right side outer needle, the output of OR-gate 44 rises and the count of UP-DOWN counter 24 is incremented by one, by which the display unit 13 indicates "22". At the same time the RESET signal to the counter 54 disappears, and the counter 54 counts up by one upon an output pulse GN from OR-gate 46. Thus the decoder 55 produces a signal of "1" at its terminal 1 (TOP 1). At this time the flip flop 59 produces an Ri of level "1," and the code A of the subtracter 63 indicates the needle number of the right side outer needle. Therfore the output A-B code of the subtracter 63 indicates "−81," which corresponds to the right width. The output A-B code is stoned in the latches 35 and 36 by the output signal TOP 1. When the cam 5 depresses the next left hand needle of the right side outer needle, the OR-gate supplies a pulse GN and the decoder shifts the high ("1") signal to terminal 2 (TOP 2). The A-B code of the subtracter 63 indicates "−80," which indicates that the number of the depressed needle is increasing this increase is detected by the counter 58, latch 60 and comparator 64, and comparator 64 supplies a "1" signal to AND-gate 61, which sets the flip flop 59 to produce a Le signal of "1". Thus "−80" is newly memorized in latch 35. The latch 36 has the memory "−81". Continuing traverse movement of the cam 5 toward left thus changes the A-B code of the A-B code of the subtracter 63 and the memory of the latch 35, such as "−79", "−78", "−77", . . . When the cam 5 depresses the standard center needle, the A-B code of the subtracter 63 and the memory of the latch 35 are "0". Continuing traversing movement of the cam 5 further changes the A-B code of the subtracter 63 and the memory of the latch 35, such as "+1", "+2", "+3", . . . When the final left side outer needle is depressed by the cam 5, the latch 35 memorizes "+81", by which the knitting operation of the second step No. 21 is accomplished. Since the switch 65 is closed to the +, −indication lamps 27*c*, 27*d* and 30*c* 30*d*, and also the switch 66 is closed and the memory devices 11 and 12 produce codes that indicate "+79" and "−79" respectively, the final indication on the display units 16 and 19 are "−2" and "+2" respectively. "−2" on the display unit 16 indicates a decrease of left half stitches toward the right by two, and "+2" on the display unit 19 indicates a decrease of right half stitches toward the left by two. As described hereinbefore referring the Table 1, the mark "−" indicates the direction of the knitting width adjustment toward the right, whereas the mark "+" indicates the left. The operator can confirm the left half and right half widths, if desired by turning the switches 65 and 66 into the position shown in FIG. 11. The knitting operation from step 180 to step 209, with the switches 26, 39 and 40, is the same as described hereinbefore referring FIG. 10.

In the embodiments shown in FIG. 7, FIG. 10 and FIG. 11, adjustment of the knitting width may be possible by selecting the diameter or expansibility of yarns and/or using a stitch pitch adjusting dial. Experienced operators may adjust the width by adding or subtracting some stitches to the value indicated by the display units 16 and 19.

According to the present invention the operator can select a knitting fabric piece outline pattern by actuating the read out address setting switches 22. The knitting stitch numbers or width are shown on the display units 16 and 19, step by step for the fabric piece. Therefore the operator can easily set and confirm every step or course width of the fabric piece.

Obviously many modifications and variations of the present invention are possible in the light of the above teachings. It is terefore to be understood that, within the scope of the appended claims, the invention may be practiced otherwise than as specifically disclosed.

The invention claimed is:

1. A knitting width indication system for knitting machines, comprising:

electronic memory device means for storing a plurality of fabric piece outline data;

pattern width indication display device means for displaying knitting information;

electronic control circuit means for addressing the electronic memory device means, said electronic control circuit means including at least a manually operated switch circuit to set the read out address for the electronic memory device means and a read out address increment circuit which is energized in synchronism with the traversing movement of the carriage of the knitting machine; and manually operated change over circuit means, responsive to the electronic control circuit means, for selectively supplying the pattern width indication display device means with fabric piece outline data or data representing the stitch difference between successive steps of a fabric piece outline.

2. A knitting width indication system for knitting machines as claimed in claim 1, wherein the pattern width indication display device means includes at least a pair of display units, the first of which displays fabric piece first half information and the second of which displays fabric piece second half information, and further comprising output exchange gate circuit means for selectively supplying the first and second display units with fabric piece left half and fabric piece right half information, respectively, or fabric piece right half and fabric piece left half information, respectively.

3. A knitting width indication system for knitting machines, comprising:

electronic memory device means for storing a plurality of fabric piece outline data;

pattern width indication display device means for displaying knitting information;

electronic control circuit means for addressing the electronic memory device means, said electronic control circuit means including at least a manually operated switch circuit to set the read out address for the electronic memory device means and a read out address increment circuit which is energized in synchronism with the traversing movement of the carriage of the knitting machine;

manually operated change over circuit means, responsive to the electronic control circuit means, for selectively supplying the pattern width indication display device means with fabric piece outline data or data representing the stitch difference between successive steps of a fabric piece outline; and subtracter means for supplying the pattern width indication display device means with information representing the stitch difference between successive steps of the fabric piece outline.

4. A knitting width indication system for knitting machines as claimed in claim 3, wherein the pattern width indication display device means includes at least a pair of display units, the first of which displays fabric piece first half information and the second of which displays fabric piece second half information, and further comprising output exchange gate circuit means for selectively supplying the first and second display units with fabric piece left half and fabric piece right half information, respectively, or fabric piece right half and fabric piece left half information, respectively.

5. A knitting width indication system for knitting machines as claimed in claim 3, wherein the electronic memory device means includes a pair of semiconductor memory devices, the first of which contains a plurality of fabric piece left half outline data and the second of which contains a plurality of fabric piece right half outline data.

6. A knitting width indication system for knitting machines, comprising:

electronic memory device means for storing a plurality of fabric piece outline data, said electronic memory device means including a first semiconductor memory containing left half width data for each step of at least one knitting pattern, and a second semiconductor memory containing right half width data for each course of at least one knitting pattern;

pattern width indication display device means for displaying knitting information, said pattern width indication display device means including a read out address display unit and left and right half display units;

electronic control circuit means for addressing the electronic memory device means, said electronic control circuit means including at least a manually operated switch circuit to set the read out address for the electronic memory device means and a read out address increment circuit which is energized in synchronism with the traversing movement of the carriage of the knitting machine;

manually operated change over circuit means, responsive to the electronic control circuit means, for selectively supplying the pattern width indication display device means with fabric piece outline data or data representing the stitch difference between successive steps of a fabric piece outline; and output exchange gate circuit means for supplying data from the first and second semiconductor memories to the left half and right half display devices selectively.

7. A knitting width indication system for knitting machines as claimed in claim 6, wherein the system further comprises first and second subtracter means for supplying the left half and right half display units with signals representing the stitch differences between successive steps of the left half and right half width, respectively, through the manually operated change over circuit means.

8. A knitting width indication system for knitting machines having traversely movable carriages operable to produce fabric pieces corresponding to predetermined patterns, the patterns determining the width and configuration of successive rows of knitting, comprising:

addressable memory means for storing fabric piece outline data in consecutive memory locations corresponding to consecutive rows of knitting;

pattern width indication display device means for displaying knitting information;

first means for detecting the traverse of a carriage;

control circuit means, responsive to said first means, for sequentially addressing said memory means, said control circuit means additionally comprising second means for manually setting an initial address; and third means, responsive to said control circuit means, for supplying fabric piece outline data to said pattern width indication display device means.

9. The system of claim 8, wherein said second means comprises selectable switch means for rapidly incrementing and decrementing an initial address and selectable switch means for incrementing and decrementing an initial address once per switch activation.

10. The system of claim 9, wherein said third means additionally comprises manually selectable means for supplying data representing the difference between successive rows of a fabric piece outline.

11. The system of claim 10, wherein said pattern width indication display device means comprises two display devices, one display device being allocated to displaying information regarding one half of a pattern and the other display device being allocated to displaying information regarding the other half of the pattern, and further comprising output exchange gate circuit means for selectively changing the display devices on which information is displayed.

* * * * *